United States Patent [19]

Gabel

[11] 4,041,822

[45] Aug. 16, 1977

[54] SAUSAGE SLICING MACHINE

[76] Inventor: Floyd S. Gabel, 5008 NW. Steanson, Oklahoma City, Okla. 73112

[21] Appl. No.: 695,177

[22] Filed: June 11, 1976

[51] Int. Cl.[2] ..... B26D 1/28

[52] U.S. Cl. ..... 83/409.2; 83/422; 83/425.3; 83/435.2; 198/654; 83/823; 144/245 B

[58] Field of Search ..... 83/409 R, 409.1, 409.2, 83/425.3, 425.2, 423, 823, 122, 824, 435.2; 198/654; 144/245 A, 245 B

[56] References Cited

U.S. PATENT DOCUMENTS

| | | | |
|---|---|---|---|
| 800,426 | 9/1905 | Calkins | 83/425.3 |
| 2,298,955 | 10/1942 | Mason et al. | 83/409.2 |
| 3,288,271 | 11/1966 | Burford | 198/654 |
| 3,654,978 | 4/1972 | Gabel | 83/422 |

*Primary Examiner*—Donald R. Schran
*Attorney, Agent, or Firm*—William R. Laney

[57] ABSTRACT

A sausage slicing machine which includes a framework, an endless conveyor mounted on the upper side of the framework, and a plurality of articulated, automatically operable cradle elements connected to, and movable with, the endless conveyor. A plurality of opposed, circular cutter blades are mounted on the framework over the endless conveyor for rotation about a horizontal axis extending normal to the direction of conveyor movement. The blades are separated by a plurality of spacing and guiding plates and are dimensioned to pass through gaps formed in the cradle elements to cut into patties, a roll of sausage carried in the cradle elements. The conveyor and blades are driven from a prime mover mounted on the framework.

16 Claims, 5 Drawing Figures

SAUSAGE SLICING MACHINE

BACKGROUND OF THE INVENTION

1. Field of the Invention

This invention relates to machines for slicing ground meats into relatively thin slices, and particularly, to machines for slicing rolls of sausage into thin, discrete patties.

2. Brief Description of the Prior Art

In my prior U.S. Pat. Nos. 3,654,978 and 3,669,167, I have described two types of powered machines utilized for slicing bulk meat into relatively thin slices, and particularly, in the case of the most recently patented of those machines, for slicing a sticky meat, such as sausage, into thin patties. It is with respect to those machines illustrated and described in my prior patents that the present invention constitutes an improvement.

A number of machines have previously been built, marketed and placed in use for slicing various comestibles and food stuffs into thin slices or into patties. Machines functioning to manufacture, by slicing or other technique, thin, separated slices of hamburger meat or ground beef are well known. Many of these machines function quite effectively at high speed to produce large numbers of marketable patties or slices in a relatively short time.

A special problem is encountered in the preparation of patties of sausage. This meat has a tacky or sticky quality which causes it to be adherent to any surface with which it may come into contact, and it is, moreover, relatively soft and is greasier than ground beef. These characteristics make it more difficult to cleanly slice a roll or bulk quantity of sausage into thin patties in such a way that the patties are retained in a selected snd discrete geometric form without distortion, and without loss of significant quantities of the meat by reason of adherence of particles to the slicing blades, or to the mechanism which carries the sausage through the blades. Moveover, the softness and pliability of the sausage require that in order for a slicing operation to be successfully carried out, the force applied to the sausage must be such that a flattening of the patty is not developed, and distorting forces are minimized. Finally, the softness and stickiness of sausage makes it impossible to manufacture patties thereof in forming or molding machines.

In the machines described in my two prior patents referred to above, sausage in roll form can be sliced relatively effectively in comparison to other machines which have been used for slicing other food stuffs. Nevertheless, some lack of optimization has been observed in that my prior slicing machines have not been able to consistently yield truly round, disk-shaped patties which display little distortion or flattening at the side edges thereof, and which do not tend to ride up on the cutting blades or become distorted in the course of cutting. Further, the machines have left room for some improvement in reducing the amount of sausage lost through adherence to the cutting blades or to the cradles or structures in which the sausage roll is placed as it is passed through the cutting blades.

BRIEF DESCRIPTION OF THE PRESENT INVENTION

The present invention provides an improved meat cutting apparatus, and particularly, a machine which functions especially effectively in the slicing of bulk sausage into thin, geometrically uniform patties at a high rate of speed. Further, the machine of the present invention is highly efficient in the sense of minimizing any loss of particles of sausage through adherence to parts of the machinery with which the sausage is in contact in the course of processing.

Broadly described, the sausage slicing apparatus of the present invention includes a supporting framework which extends generally vertically and which carries adjacent its upper side, an endless conveyor which is driven from a suitable prime mover preferably mounted on the framework. The endless conveyor carries at spaced intervals therealong, a plurality of cooperating, articulated, automatically openable cradle elements which are periodically opened apart from each other as the conveyor traverses its course of travel, and are then reclosed at critical times to facilitate the retention in the cradle formed by the several closed cradle elements, of a sausage roll which is to be slice into patties by the machine. The actual slicing is effected by spaced, circular cutter blades which are each very thin, and are mounted on the upper side of the framework over the endless conveyor for rotation about a horizontal axis extending normal to the direction of the conveyor movement. The circular cutter blades, which each extend in a substantially vertical plane, are separated from each other by a plurality of spacing and guiding plates which function to provide support to the very thin cutter blades and also keep them in proper alignment for passing through gaps or spaces formed in the several cradle elements as each cradle passes the blades in the course of the conveyor travel. The machine is further provided with a plurality of guiding elements to assure that the sausage roll is confined laterally during its travel through the cutter blades and is therefore prevented from becoming distorted in an axial direction along the length of the sausage roll.

An important object of the present invention is to provide a sausage slicing machine which is capable of producing, in a high speed fashion, a large number of discrete, geometrically uniform, disk-shaped sausage patties as a result of subdivision of a mass of bulk sausage during conveyance of the sausage through the machine.

A further object of the invention is to provide a sausage slicing machine which minimizes distortion of the geometry of round sausage patties produced by the machine.

A further object of the invention is to provide an easily operated, semi-automatic sausage slicing machine which operates with minimal loss of sausage meat due to adherence thereof to parts of the machinery with which the meat is in contact as it traverses the machine.

Yet another object of the invention is to provide a ruggedly and sturdily constructed sausage slicing machine which is capable of high speed operation by a single operator, and which is characterized in having a long and trouble-free operating life.

Additional objects and advantages of the invention will become apparent as the following detailed description of a preferred embodiment of the invention is read in conjunction with the accompanying drawings which illustrate such preferred embodiment.

GENERAL DESCRIPTION OF THE DRAWINGS

DETAILED DESCRIPTION OF A PREFERRED EMBODIMENT OF THE INVENTION

Figure 1:
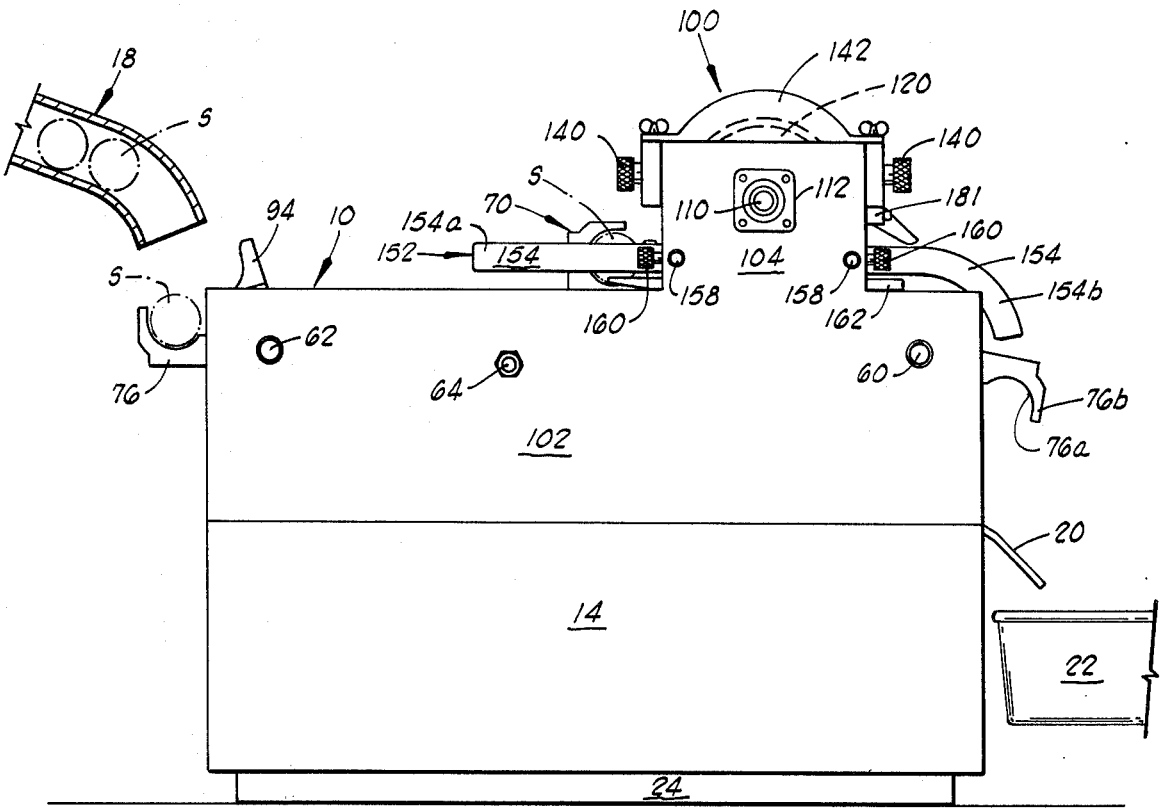
FIG. 1 is a side elevation view of the sausage slicing machine of the present invention.

Referring initially to FIG. 1 of the drawings, the sausage slicing machine of the present invention is designated generally by reference numeral 10 and includes an interior main framework 12 (see FIGS. 2–4) which is closed on its outer opposite sides by means of housing side plate members 14 and 16, and an end plate 15. In one manner of utilizing the sausage slicing machine 10, elongated rolls of package sausage meats are fed to certain cradle assemblies forming a pair of the sausage slicing machine, and hereinafter described, by means of an automatic feed chute 18. The sausage patties resulting from the slicing operation are discharged upon an inclined plate 20, and are collected in a suitable container 22 or, alternatively, can be discharged upon a conveyor for conveyance to a remote packaging location.

The main framework 12 includes a base block 24 which supports a bottom plate 26, and the framework further includes vertically extending frame members 27 at four opposed corners of the framework to provide a generally rectangular cross-sectional configuration to the framework. Mounted upon the bottom plate 26 within the framework is a prime mover 28, such as an electric motor. The prime mover 28, through a belt 30, drives a peripherally grooved wheel 32 which is keyed to a shaft 34 supported above the bottom plate 26. The shaft 34 also has keyed thereto, a second peripherally grooved wheel disposed parallel to, and behind, the wheel 32 (and thus not visible). The second grooved wheel frictionally engages a drive belt 36 employed for a purpose hereinafter described. A relatively small pulley wheel 38 is also keyed to the shaft 34 for rotation therewith, and is peripherally engaged by a drive belt 40. The drive belt 40 passes around and drivingly engages a peripherally grooved wheel 42 which is keyed to a shaft 44. The shaft 44 also carries a wheel behind, and extending parallel to, the wheel 42, and the former wheel drivingly engages a drive belt 46 used for a purpose hereinafter described.

Mounted on the upper side of the framework 12 in a superstructure subframe 49 is a conveyor assembly designated generally by reference numeral 50. The conveyor assembly 50 includes a single endless chain 52 which is passed around a drive sprocket 54 and engages the peripheral teeth 56 of the sprocket. The chain 52 also passes around and engages the teeth of an idler sprocket 58 disposed on the opposite side of the framework from the sprocket 54. The sprockets 54 and 58 are keyed to shafts 60 and 62, respectively, which shafts are suitably journaled in the subframe 49 to undergo rotation as the endless chain 52 moves during operation of the conveyor subassembly. A suitable tensioning roller or sprocket 64 is provided intermediate the sprockets 54 and 58, and is adjustable in relation to the chain 52 to facilitate the tensioning of the chain during operation of the conveyor assembly 50.

Secured to the endless chain 52 at spaced intervals therealong are a plurality of cradle subassemblies 70. Each of the cradle subassemblies 70 includes a plurality of articulated, automatically openable cradle elements. The several elements of each cradle subassembly 70 include a trailing element 72, which in turn is made of a transversely extending base plate 74 secured at a medial position therealong by welding or other suitable means to the chain 52, and a plurality of transversely spaced roll backing plates 76 (see FIGS. 3 and 4). Each of the roll backing plates 76 is of generally L-shaped configuration, and projects normal to the base plate 74. Further, each of the roll backing plates has a leading edge which is recessed with an arcuate concavity or recess **76*a* formed on a segment of a circle and terminating at an overhanging finger 76*b*. It may here be pointed out that the base plates 74 of the trailing conveyor elements 72 are each secured to linkages in the chain 52 so as to be able to traverse the circular path of the chain around the sprockets 54 and 58, as will be clearer from the subsequent and following discussion. Further, the several roll backing plate 76 of the trailing cradle elements 72 are spaced transversely from each other along the base plate 74** by a distance which is sufficient to permit passage therethrough of the circular cutter blades to be hereinafter described.

Each of the cradle subassemblies 70 further includes a central cradle element designated generally by reference numeral 80. Each of the central cradle elements 80 includes a transversely extending base plate 82 which is secured at a medial portion thereof to one of the links in the conveyor chain 52, and two pairs of guide plates 84 which project normal to the plane of the transverse base plate 82, and are disposed on opposite sides of the conveyor chain 52. It will be noted that the guide plates 84 extend from the base plate 82 in the direction of the opposite run of the conveyor chain 22 from that upon which they are located. Stated differently, the guide plates extend into the space defined between the two runs of the conveyor chain as this chain is extended between the sprockets 54 and 58.

Projecting from the opposite side of the base plate 82 from that side to which the guide plates 84 are secured is a plurality of transversely spaced, roll bottoming plates 86. The roll bottoming plates 86 project normal to the base plate 82 and are each provided in the upper side thereof with an arcuate recess or cavity which is formed on a circular segment of equal radius of curvature to the circular segment characteristic of the recess 76a formed in the leading side of the roll backing plate 76. Further, the arrangement and spacing of the roll bottoming plates 86 along the transverse base plate 82 is correlated to the transverse spacing of the roll backing plate 76, so that these plates are in coplanar alignment, and during operation of the sausage slicing machine, at one time are in juxtaposition and define, by the contiguous position of the circle segments of the recesses in the two plates, a continuous segment of a circle equal in size to the sum of the two circular segments. It should further be pointed out that the transverse base plate 82, in being welded or otherwise suitably secured to a link of the chain 52 independent from that link to which the transverse base plate 74 of the trailing element 72 is secured, is capable of independent movement with respect to the base plate 74, so that the central element 80 can undergo movement independently of the trailing element 72 as the conveyor chain 52 transverses the sprockets 54 and 58.

The third element of each of the cradle subassemblies 70 is a leading element, designated generally by reference numeral 90. The leading element 90 includes a transversely extending base plate 92 which is secured to one of the links of the chain 52 and projects normal to the direction of travel of the chain 52. Projecting upwardly from the base plate 52, and normal thereto, are a plurality of transversely spaced, roll confining plates 94. The positioning of the roll confining plates 94 along the transverse base plate 92, and the spacing thereof, are such that these plates will occupy a position in coplanar alignment with the roll bottoming plates 86 and the roll backing plates 76 when the respective cradle subassembly 70 containing the articulated, relatively movable cradle elements 72, 80 and 90 is in the sausage-carrying status. At this time, these elements are closed up to the position in which the three elements are contiguous to each other, and the base plates 74, 82 and 92 thereof are in coplanar alignment. The trailing side or edge of each roll limiting plate 94 is relieved along an arcuate line to provide a recess or concavity 94*a* in these plates are accommodating the protuberant leading side of a sausage roll of substantially cylindrical configuration.

Figure 3:
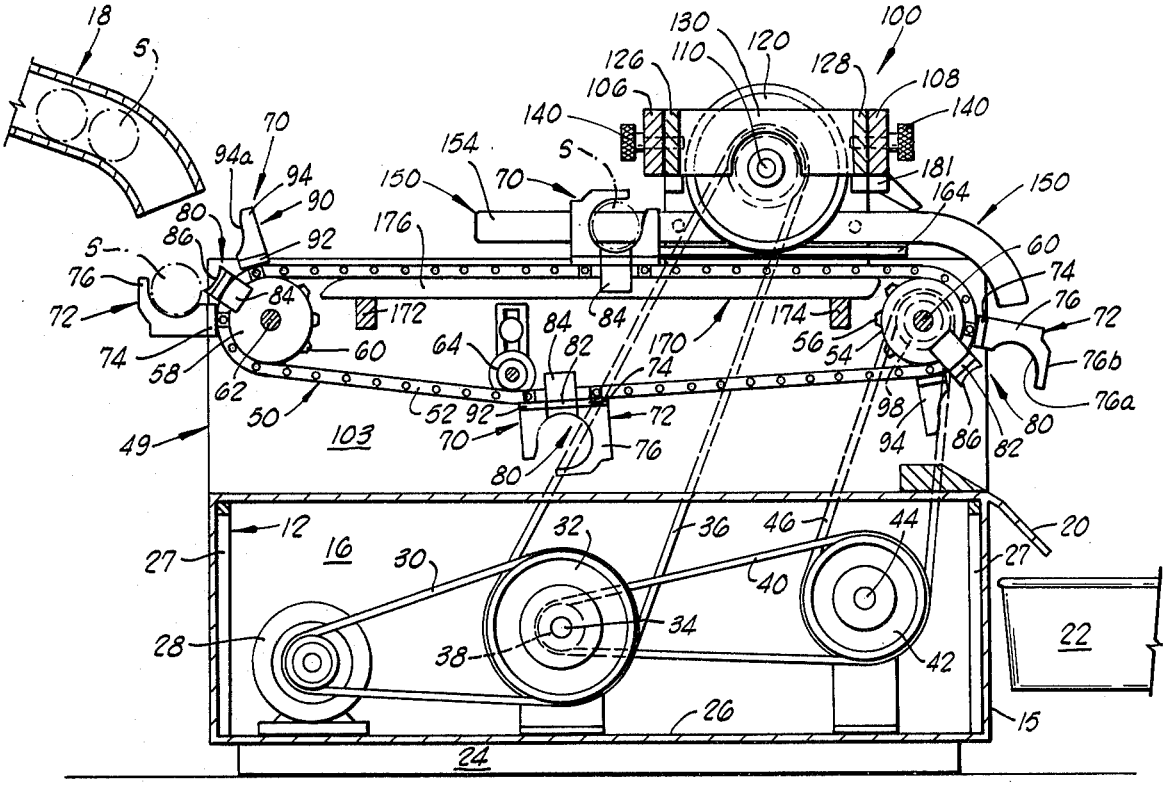
FIG. 3 is a sectional view taken along line 3—3 of FIG. 2.

In referring to FIG. 3 of the drawings, it will be noted that in the conveyor assembly 50 in use in the illustrated embodiment of the invention, four of the cradle subassemblies 70 are provided in spaced relation along the length of the endless chain 52. It will also be perceived that two of these cradle subassemblies are, in the status shown, traversing the sprockets 54 and 58 during movement of the chain 52 thereover, and two of the cradle subassemblies are in the close-up, roll-carrying position at the upper side and lower side of the conveyor assembly. It should further be pointed out that, during operation of the sausage slicing machine of the invention, the conveyor assembly 50 is driven by the endless belt 46 which passes around a suitable pulley 98 which is keyed to the shaft 60. The direction of the rotational drive of the pulley 98 is such that the endless chain 52 will be caused to move in a clockwise direction, as viewed in FIG. 3, around the sprockets 54 and 58 during operation of the machine.

Figure 4:
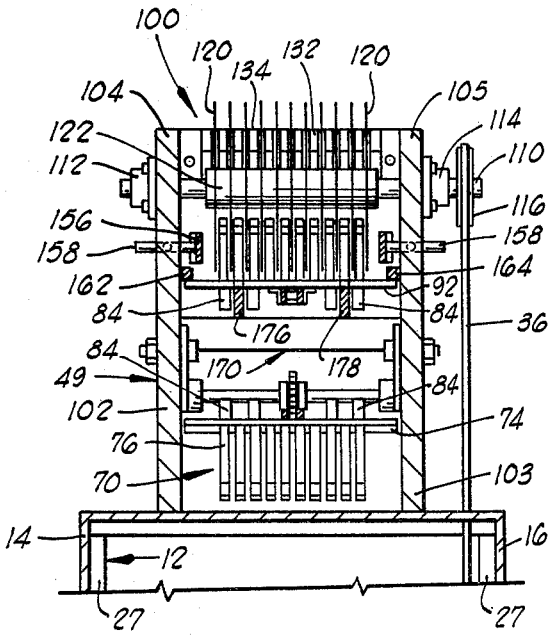
FIG. 4 is a sectional view taken along line 4—4 of FIG. 2.

A cutter assembly 100 is mounted in the superstructure subframe 49 over the conveyor assembly 50. The subframe 49 includes a pair of vertically extending, substantially parallel side plates 102 and 103 which, in the illustrated embodiment, are formed with upward side plate projections 104 and 105. The side plates 102 and 103 function to journal the shafts supporting the several sprockets 54, 58 and 64. The subframe 49 further includes a pair of transversely extending, substantially parallel frame plates 106 and 108 which are secured to the upper sides of the side plates projections 104 and 105 and form therewith a generally rectangular enclosure as illustrated in FIGS. 3 and 4. It will be noted in referring to FIG. 3 that the frame plates 106 and 108 are spaced upwardly from the upper run of the endless chain 52 by a distance sufficient to clear the cradle assemblies 70 as they pass beneath the frame plates during the operation of the sausage slicing machine, and specifically, as the upper run of the chain 52 is moved from left to right as it is viewed in FIG. 3 of the drawings.

An elongated blade shaft 110 extends transversely across the conveyor assembly 50 with its opposite end portions projecting through journal bearings 112 and 114 in the plate projections 104 and 105. At one of its ends, the blade shaft 110 has a peripherally grooved wheel or pulley 116 keyed thereto, the peripheral groove therein is dimensioned to engage the drive belt 36. Axially spaced along the length of that portion of the blade shaft 110 which is located between the side plates 102 and 104 are a plurality of very thin, circular cutter blades 120. The cutter blades 120 are spaced from each other along the shaft 110 by means of a plurality of spacer blocks or disks 122 extending around, and keyed to, this shaft. The circular cutter blades 120 are spaced from each other by the spacer blocks 122 by a distance such that the blades will pass between the several transversely spaced, roll confining plates 76, 86 and 94 constituting a part of each of the three elements 72, 80 and 90 of each cradle subassembly 70.

For the purpose of further guiding the circular cutter blades 120, and preventing them from becoming distorted during usage, a blade gate subassembly 124 is removably secured in the rectangular enclosure defined by the plate projection 104 and 105 and the transverse frame plates 106 and 108. The plate grate subassembly 124 (see FIG. 2) includes a pair of horizontally spaced, transversely extending support members 126 and 128 which are joined or interconnected bu a slotted web plate 130. The slotted web plate 130 has a plurality of parallel, horizontally spaced slots 132 formed therein and dimensioned to permit extension therethrough of a portion of each of the circular cutter blades 120. Each slot 132 is defined by parallel plate subelements 134 of the web plate 130, and these plates are recessed centrally therealong to accommodate the shaft 110 and spacer blocks 122.

Figure 2:
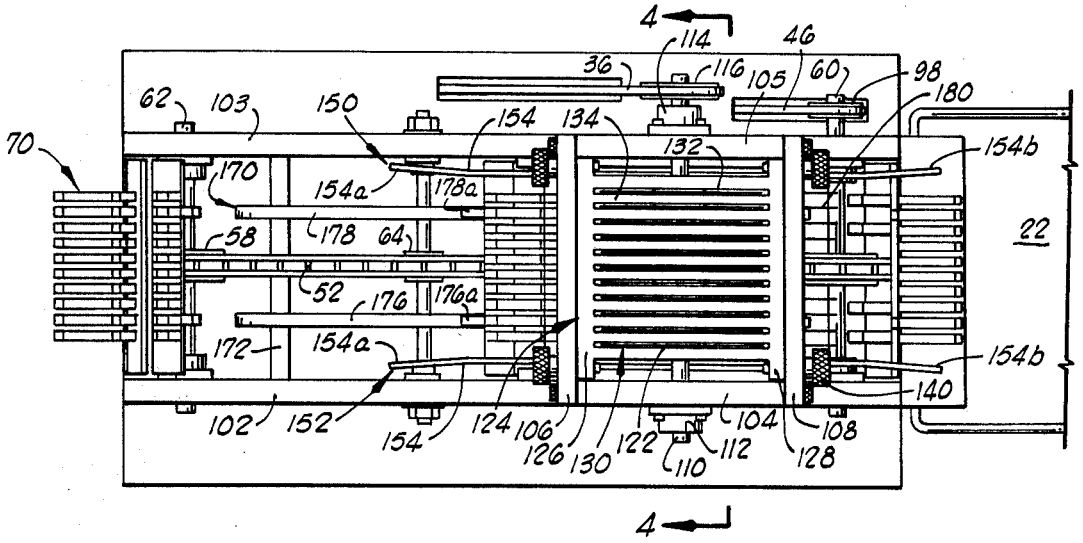
FIG. 2 is a plan view of the sausage slicing machine illustrated in FIG. 1.

For the purpose of detachably retaining the blade gate 124 in its operative position, as illustrated in FIGS. 2 and 3 of the drawings, each of the transverse frame plates 106 and 108 is provided with a plurality of threaded holes extending therethrough to permit threaded fastening elements 140 to be threaded into registering apertures or openings formed in the support members 126 and 128. With the use of the fastening elements 140, the blade grate subassembly 124 may be removably positioned in the cutter assembly 100 to provide rigid structure guiding and protecting the thin cutter blades 120 during operation of the sausage slicing machine.

A suitable protective cover 142 is secured over the top sides of the blades 120 when the machine is in use.

A pair of lateral guide plate subassemblies 150 and 152 are supported from each of the side wall plate projections 104 and 105, and are mounted in transversely spaced relation to each other on opposite sides of the conveyor assembly 50, and above the upper run of the endless chain 52. Each of the lateral guide plate subassemblies 150 and 152 includes an elongated guide plate 154, and each of the guide plates 154 is characterized in having outwardly flaring end portions 154*a* and 154*b* at its opposite ends (see FIG. 2). It will also be noted in referring to FIGS. 1 and 3 that the end portion 154*b* of each of the guide plates 154 is curved downwardly in a generally semi-circular configuration so as to follow the curvature of the endless chain 52 as it passes around the sprocket 54. Finally, it will be noted in referring to FIGS. 1 and 3 that the guide plates 154 are transversely spaced by a distance sufficient to clear the opposit ends of each of the cradle subassemblies 70, as each subassembly is moved by the conveyor assembly 50 between the guide plates 154, and that the guide plates are vertically aligned with the sausage roll-accommodating hollow interior of each of the cradle subassemblies 70 as this space is defined by the recessed edges of the several plates 76, 86 and 94.

Figure 5:
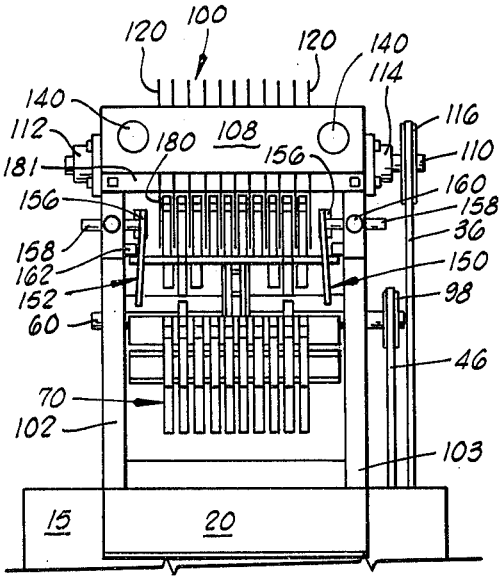
FIG. 5 is an end elevation view showing the discharge end of the sausage slicing machine as it appears when the machine is oriented at 90° from the position illustrated in FIG. 1.

Each of the lateral guide plate subassemblies 150 and 152 further includes a pair of horizontally spaced support blocks 156 (See FIGS. 4 and 5) which are welded or otherwise suitably secured to the outer side of the guide plates 154, and which have an adjusting shaft 158 projecting therefrom. The adjusting shaft 158 associated with each of the support blocks 156 extends slidably through the adjacent side plate projections 104 or 105 as shown in FIGS. 4 and 5. A suitable set screw 160 is threaded through a threaded aperture formed in the respective side plate projection 104 or 105 in alignment with the respective adjusting shaft 158 so that the position of these shafts in relation to the side plate projections can be set following in and out adjustment. In this wa, the spacing beween the guide plates 154 can be varied to accommodate cradled sausage rolls of varying length.

Secured to the facing or internal sides of the side plate projections 104 and 105, and projecting horizontally therealong, are a pair of parallel hold down rods 162 and 164. The hold down rods 162 and 164 are positioned below the lateral guide plate subassemblies 150 and 152 and, as best illustrated in FIGS. 3 and 4, are located at a vertical level such that they will contact and bear against the upper surface of the transversely extending base plates 74, 82 and 92 of the trailing, central and leading elements 72, 80 and 90, respectively, of each of the cradle assemblies 70 at the time that the respective cradle assembly is passing through the circular cutter blades 120 of the cutter assembly 100. As will be note in referring to FIG. 1, the leading end of each of the guide bars 162 and 164 has a slightly tapered or beveled under side so as to permit the base plates 74, 82 and 92 to pass smoothly thereunder during the travel of the conveyor assembly 50.

A central tracking and supporting subassembly 170 is mounted between the side plates 102 and 103 and is best illustrated in FIGS. 2, 3 and 4. The central tracking and supporting subassembly includes a pair of horizontally spaced, transversely extending bars 172 and 174 which project between and have their opposite ends secured to the side plates 102 and 103. Supported on the upper side of the transversely extending bars 172 and 174 are a pair of horizontally spaced elongated runner tracks 176 and 178. Each of the runner tracks 176 and 178 has a tapering or beveled leading and positioned relatively near to the sprocket 58. Further, each of the runner tracks 176 and 178 has a transverse thickness such that it can pass between the pairs of guide plates 84 carried on the central element 80 of each cradle subassembly 70. Finally, each of the tracks 176 and 178 has a transverse width (as measured in the vertical plane occupied by the respective track) which undergoes an enlargement at a location intermediate the length of the respective runner track, and commencing at a point slightly ahead of, or upstream from, the cutter assembly 70. This enlargement of each of the runner tracks 176 and 178 is illustrated in FIGS. 2 and 3, the enlargement of the two runner tracks is referred to for reference purposes, by reference numerals 176*a* and 178*a,* respectively.

At the discharge side of the cutter assembly 100, a finger plate 181 is secured across the vertical edges of the side plate projections 104 and 105, and carries a plurality of thin, transversely spaced, discharge fingers 180 which are aligned with the cutter blades 120.

OPERATION

In the use of the sausage slicing machine 10 of the invention, the machine is started, of course, by starting the prime mover 28. The conveyor assembly 50 and the cutter assembly 100 are actuated through the belts 36, 40 and 46. The conveyor assembly 100 is driven from the drive sprocket 54 to cause the endless chain 52 to be driven around this sprocket and the idler sprocket 58. Tension in the chain 52 is adequately maintained by means of the tensioning roller or sprocket 64.

As the chain 52 is driven, it carries with it, the several cradle subassemblies 70. These cradle subassemblies 70 are articulated structures and, as previously indicated, include three different elements which are positioned differently in relation to each other, according to the point in the transverse of the endless chain which they occupy at different times. Thus, referring to the cradle subassembly 70 shown at the left hand side of FIGs. 1 and 3, it will be noted that at this time, the chain 52 of the conveyor assembly 50 is traversing the sprocket 58, and the trailing element 72, central cradle element 80 and leading cradle element 90 of the cradle subassembly 70 are opened apart from each other. This opening apart action is permitted by the construction by which the several base plates 74, 82 and 92 of the cradle elements 72, 80 and 90 are attached to separate links of the chain, and can move in relation to each other, just as these separate links can.

After one of the trailing cradle elements 72 has traversed one of the sprockets 54 and 58, and is riding upon a straight section of the chain 52 in the upper or lower run thereof, the cradle elements 72, 80 and 90 are brought into juxtaposition and closed up to form an enclosure which has a relatively small opening at the upper and leading side thereof. This configuration of the several cradle elements is depicted by the lowermost cradle subassembly 70 shown in FIG. 3, as well as that cradle subassembly which is about to traverse the cutter assembly 100 mounted in the upper portion of the superstructure subframe 49.

As one of the cradle subassemblies 70 traverses the sprocket 58 with that portion of the chain 52 in engagement therewith, a sausage roll S is permitted, by suitable automatic feeding valving (not shown), to gravitate from the chute 18 into the arcuate recess or concavity 76*a* carried in the leading edges of the several transversely spaced roll backing plates 76 which form a part of the trailing element 72. The radius of curvature of each of the arcuate recesses or cavities is such that most sausage rolls to be carried in one of the cradle subassemblies during cutting will mate with or register with these concavitities. As the cradle subassembly 70 reaches the upper side of the sprocket 58, the cradle elements 72, 80 and 90 are closed up with each other to form the closed and aligned cradle subassembly. At this time, the sausage roll S, which is generally packaged in a thin skin or membrane and thus has a certain amount of inherent integrity and geometric symmetry, is closed within the hollow interior of the cradle subassembly. It is important to note that at this time, the overhanging finger 76*b* carried on each of the transversely spaced roll backing plates 76 extends across the top or upper side of the sausage roll, and this prevents lifting or rising of the sausage roll during the cutting action hereinafter described.

As the closed cradle subassembly 70 containing a sausage roll S advances with the upper run of the chain 52 (toward the right as the machine is viewed in FIGS. 1 and 3), the downwardly depending guide plates 84 carried on the lower side of the transversely extending base plate 82 straddle the runner tracks 176 as shown in FIG. 4. This straddling action affords guidance to the cradle subassembly 70, and increases the stability with which it moves in the operation of the conveyor assembly 50. It also assures proper alignment of the several transversely spaced backing plates 76 and the transversely spaced roll confining plates 94. This function is important to assure that there is no interference or fouling to occur between these elements of the cradle subassembly with the cutter blades 120 forming a portion of the cutter assembly 100.

As the cradle subassembly 70 carrying the sausage roll S is further advanced, the opposite ends of the roll move into contact, by a light wedging action, with the interior surfaces of the tww opposed, transversely spaced, horizontally extending elongated guide plates 154. This action is gradually accomplished by reason of the flaring end portions 154*a* located at the forward ends of the two elongated guide plates. The sausage roll S is now firmly retained by the enclosing elements (74, 80 and 90) of the cradle subassembly in which it is carried, and by the axially confining effect of the elongated guide plates 154 of the lateral guide plate subassemblies 150 and 152.

Continuing advance of the cradle subassembly carrying the sausage roll along the upper run of the endless chain 52 brings the lower sides of the transversely extending base plates 74, 82 and 92 of the several cradle elements 72, 80 and 90 into sliding contact with the upper side of the enlargements 176a and 178a of the runner tracks 176 and 178. This sliding action effects a further stabilizing of the cradle in a fixed, guided status, since it imparts further tension to the chain 52 and prevents vibration from the true and desired path of travel of the several transversely spaced, vertically extending plates 76, 86 and 94 in the respective cradle elements 72, 80 and 90.

As the cradle subassembly 70 with a sausage roll S carried therein moves into the cutter assembly 100, the leading side of the sausage roll is contacted by the very sharp cutting edges of the thin cutter blades 120. These cutter blades 120 are positioned to pass between the several transversely spaced roll confining plates 94 disposed at the leading side of the leading cradle element 90. They also will pass between the transversely spaced roll bottoming plates 86 which project upwardly from the transversely extending base plate 82 of the central cradle element 80. The lowermost (horizontal) tangent to each of the cutter blades 120 is located at a lower level than a horizontal tangent to each arcuate recess formed in the upper side of each of the roll bottoming plates 86, so that the sausage roll will be completely cut through by the several cutter blades 120.

It is important to the proper functioning of the apparatus of the invention, and to its long and effective trouble-free service life, that there be no contact between the finely sharpened, thin cutter blades 120 and any of the rigid structural elements making up the cradle subassembly 70 at the time this subassembly traverses the blades. It is for this reason that the cradle subassembly is completely stabilized at this time by the guiding action of the guide plates 84 upon the runner tracks 176 and 178, and the upward wedging action of the enlarged portions of these runner tracks upon the underside of the transversely extending base plates 74, 82 and 92.

As the cutter blades 120 continue to rotate and cut through the sausage roll S in the traversing cradle subassembly 70, a tendency exists for the blades to force the sausage roll upwardly as the blades turn in a clockwise direction as viewed in FIG. 3. There is also some tendency for sausage meat to adhere to the sides of the cutter blades and to be carried upwardly on the sides of the blades during this portion of their travel. The structure of the present invention aids in reducing both undesirable effects. First, the overhanging fingers 76*b* forming parts of the transversely spaced roll backing plates 76 limit the freedom of the sausage roll S to shift or move upwardly. The total circular segment defined by the cumulated concavities or recesses formed in the three cradle subassemblies 72, 80 and 90 fit closely about the outer periphery of the sausage roll, and the cutting and the lifting action of the cutter blades 120 has very little effect on the geometry of the sausage roll. Thus, the patties which are formed after the roll has been cut through by the several cutter blades 120 remain virtually perfectly circular in configuration, and are not distorted or flattened.

The structure described also aids in preventing any undesirable adherence of sausage meat to the several cutter blades 120 during their cutting action. This is due to the fact that the shape of the transversely spaced roll backing plates 76 of the trailing element 72 in each of the cradle subassemblies, and particularly, the location of the overhanging fingers 76*b,* provides a wiping action in relation to the blade surfaces which tends to prevent adherence of any significantly sized sausage particles to the blades. Further, some supplementary wiping action is developed by reason of the close proximity to the sides of the blades of the parallel plate subelements 134 and the slotted web plates 130 of the blade grate subassembly 124.

In further relation to the blade grate subassembly 124, it should be pointed out that this subassembly functions primarily for the purpose of guiding and protecting the thin cutter blades 120. It will be seen that parallel plate subelements 134 extend over, and cover, a relatively large portion of the total surface area of the sides of each of the blades above the central rotational axis of the blades. The blades are prevented by this structure from warping or canting, and are made to run true over an extended period of time. The plate subelements also afford lateral support for the thin blades when they are being sharpened. Moreover, a fairly high degree of protection is afforded by this arrangement to the very sharp, thin, cutting edges of each of the cutter blades. It should be pointed out also that the blade grate subassembly 124 can be easily removed from between the frame plates 106 by unscrewing the threaded fastening elements 140 to permit complete removal of the blade grate subassembly. This facilitates replacement or maintenance of each of the cutter blades 120.

A final guiding action with also functions to retain the desired circular geometry to the patties is provided by the discharge fingers 180 which are transversely spaced across the upper side of the conveyor assembly 50, and on the discharge side of the cutter assembly 100. The discharge fingers 180 are spaced to pass between the several overhanging fingers 76*b* of the transversely spaced roll backing plates 76. As the elements 72, 80 and 90 of the cradle subassembly 70 commencing to move around the sprocket 54 are opened apart from each other, the sausage patties are prevented by the fingers 180 from being pulled apart or distorted due to adherence to the leading cradle element 90 or to the central cradle element 80.

As the trailing cradle element 72 begins to pass around the sprocket 54, opening of the several cradle elements has occurred to the point where the sausage patties may be discharged in any suitable fashion. In the illustrated embodiment of the invention, the patties are permitted to gravitate down onto the inclined plate 20, and to slide down this plate into a suitable container 22. In some instances, it may be preferred to position a receiving conveyor just low enough below the moving cradle elements to clear them as they traverse the sprocket 54, and in a position to receive the sliced patties being discharged from the concavity in the transversely spaced roll backing plates 76.

Although a preferred embodiment of the invention has been herein described in order to facilitate a thorough understanding of the basic principles which underlie the invention and constitute the essence thereof, it will be understood that various changes in the illustrated and described structures and subelements of the slicing machine can be effected without departure from these basic principles. Changes and innovations of this type are therefore deemed to be circumscribed by the spirit and scope of the invention except as the same may be necessarily limited by the appended claims or reasonable equivalents thereof.

What is claimed is:

1. A sausage slicing machine comprising:

a framework;

a conveyor assembly mounted on said framework and including:

an endless chain having an upper horizontal run and a lower horizontal run; and an articulated cradle subassembly secured to said chain and comprising:

a trailing element secured to said chain and extending transversely with respect to the direction of travel of the chain and including transversely spaced, concavely recessed roll backing plates;

a central element secured to a different part of said chain than said trailing element and movable independently of said trailing element, said central element extending transversely with respect to the direction of travel of the chain and including transversely spaced, concavely recessed roll bottoming plates; and a leading element secured to a different part of said chain than said trailing element and central element and movable independently of said trailing element and said central element, said leading element including transversely spaced, concavely recessed roll confining plates;

said trailing, central and leading elements being responsive to the travel of said chain in a straight path in said upper horizontal run to move into a contiguous, juxtapositioned relationship to each other defining a generally cylindrical, hollow interior in the cradle subassembly adapted to contain and confine a cylindrical sausage roll, and further being responsive to movement of said chain to a semicircular path between said horizontal runs to open said elements apart from each other, whereby a sausage roll can be dropped into one of said concavely recessed plates; and a cutter assembly supported above said framework over said conveyor assembly and including a plurality of rotatable, transversely spaced cutter blades aligned with the spaces between said transversely spaced, concavely recessed roll backing plates, and with the spaces between said roll bottoming plates and the spaces between said roll confining plates.

2. A sausage slicing machine as defined in claim 1 wherein:

said cradle subassembly is further characterized as including guide plate means projecting from one of said elements; and said sausage slicing machine is further characterized as including a central tracking and supporting subassembly mounted on said framework and including runner track means slidingly cooperating with said guide plate means for supporting said cradle subassembly at horizontally spaced points, and preventing transverse shifting of said cradle subassembly relative to said chain.

3. A sausage slicing machine as defined in claim 1 and further characterized as including:

a superstructure subframe projecting upwardly from, and supported by, said framework, said superstructure subframe supporting said conveyor assembly and said cutter assembly; and a pair of horizontally spaced, lateral guide plate subassemblies adjustably mounted on opposite sides of said superstructure subframe and on opposite sides of said conveyor assembly and said cutter assembly, said lateral guide plate subassemblies incuding means for laterally confining a sausage roll carried in said cradle subassembly at the opposite ends of said sausage roll as the cradle subassembly traverses the upper horizontal run of said endless chain.

4. A sausage slicing machine as defined in claim 1 and further characterized as including:

a superstructure subframe projecting upwardly from, and supported by, said framework, said superstructure subframe including:

a pair of transversely spaced, vertically extending side walls having said conveyor assembly mounted therebetween;

transversely spaced, vertically extending side plate projections projecting upwardly from said side walls; and a pair of horizontally spaced frame plates extending across said side plate projections and forming a rectangular enclosure therewith;

and wherein said cutter assembly comprises:

a plurality of disc-shaped cutter blades rotatably mounted in said rectangular enclosure; and a blade grate subassembly removably mounted in said rectangular enclosure and including a plurality of parallel plate subelements positioned between adjacent disc-shaped cutter blades.

5. A sausage slicing machine as defined in claim 4 and further characterized in including:

a finger plate mounted on said superstructure subframe and extending transversely across and over the horizontal upper run of said endless chain; and a plurality of transversely spaced discharge fingers projecting downwardly from said finger plate and at an acute angle to a plane extending normal to the horizontal plane occupied by said upper horizontal run of said endless chain, said discharge fingers being spaced from each other and positioned on said superstructure subframe to pass between said transversely spaced roll backing plates and said transversely spaced roll confining plates after said cradle subassembly has passed said cutter blades.

6. A sausage slicing machine as defined in claim 2 wherein said runner track means includes a pair of transversely spaced, horizontally extending, substantially parallel runner tracks disposed on opposite sides of said endless chain, and extending under said cutter assembly, each of said runner tracks including an enlargement therealong for biasing said cradle subassembly and the upper run of said endless chain in an upward direction.

7. A sausage slicing machine as defined in claim 6 and further characterized as including hold down rods mounted on said framework at a location for engaging said trailing, central and leading elements to prevent upward movement of said chain and a cradle subassembly attached thereto and passing under said hold down rods.

8. A sausage slicing machine as defined in claim 7 and further characterized as including:

a superstructure subframe projecting upwardly from, and supported by, said framework, said superstructure subframe supporting said conveyor assembly and said cutter assembly; and a pair of horizontally spaced, lateral guide plate subassemblies adjustably mounted on opposite sides of said superstructure subframe and on opposite sides of said conveyor assembly and said cutter assembly, said lateral guide plate subassemblies including means for laterally confining a sausage roll carried in said cradle subassembly at the opposite ends of said sausage roll as the cradle subassembly traverses the upper horizontal run of said endless chain.

9. A sausage slicing machine as defined in claim 7 and further characterized as including:

a superstructure subframe projecting upwardly from, and supported by, said framework, said superstructure subframe including:

a pair of transversely spaced, vertically extending side walls having said conveyor assembly mounted therebetween;

transversely spaced, vertically extending side plate projections projecting upwardly from said side walls; and a pair of horizontally spaced frame plates extending across said side plate projections and forming a rectangular enclosure therewith;

and wherein said cutter assembly comprises:

a plurality of disc-shaped cutter blades rotatably mounted in said rectangular enclosure; and a blade grate subassembly removably mounted in said rectangular enclosure and including a plurality of parallel plate subelements positioned between adjacent disc-shaped cutter blades.

10. A sausage slicing machine as defined in claim 9 and further characterized as including:

a finger plate mounted on said superstructure subframe and extending transversely across and over the horizontal upper run of said endless chain; and a plurality of transversely spaced discharge fingers projecting downwardly from said finger plate and at an acute angle to a plane extending normal to the horizontal plane occupied by said upper horizontal run of said endless chain, said discharge fingers being spaced from each other and positioned on said superstructure subframe to pass between said transversely spaced roll backing plates and said transversely spaced roll confining plates after said cradle subassembly has passed said cutter blades.

11. A sausage slicing machine as defined in claim 10 and further characterized as including a pair of horizontally spaced, lateral guide plate subassemblies adjustably mounted on opposite sides of said superstructure subframe and on opposite sides of said conveyor assembly and said cutter assembly, said lateral guide plate subassemblies including means for laterally confining a sausage roll carried in said cradle subassembly at the opposite ends of said sausage roll as the cradle subassembly traverses the upper horizontal run of said endless chain.

12. A sausage slicing machine as defined in claim 1 wherein said trailing element further comprises a transversely extending base plate secured at a central location on one side thereof to said endless chain and having said concavely spaced roll backing plates secured to the opposite side thereof from said chain, said roll backing plates each being further characterized in including an overhanging finger projecting over the concave recess in said roll backing plate and substantially parallel to the plane of said base plate.

13. A sausage slicing machine as defined in claim 1 and further characterized as including guiding and tracking means on said framework for stabilizing and guiding said chain and cradle subassembly during movement thereof below and past said conveyor assembly, and for limiting the lateral, transverse movement and the vertical movement thereof.

14. A sausage slicing machine as defined in claim 1 and further characterized as including:

a slotted blade grate subassembly removably supported over the framework adjacent said cutter assembly; and wherein said cutter assembly comprises a plurality of cutter blades extending through slots in said blade grate subassembly.

15. A sausage slicing machine comprising:

a framework;

a conveyor assembly mounted on the framework and including:

an endless chain having an upper horizontal run and a lower horizontal run;

an articulated cradle subassembly secured to said chain and having a plurality of separately actuable elements automatically movable between an open position apart from each other, and a closed, sausage roll-carrying position, during the course of travel of said chain; and a cutter assembly supported on the framework over the conveyor assembly, said conveyor assembly comprising:

a horizontal shaft extending transversely across the direction of travel of said endless chain and positioned thereabove;

means for driving said shaft in rotation;

a plurality of disc-shaped cutter blades keyed to said shaft for rotation therewith and spaced axially therealong; and a blade grate subassembly removably supported above the framework in proximity to the blades and including a slotted web plate having a plurality of spaced, vertically extending plate subelements each extending between two of said blades in a horizontal direction from one side thereof to the other, and projecting upwardly from said shaft a major portion of the way to the top sides of said blades, each of said plate subelements having a central recess in the lower side thereof to accommodate passage of said shaft whereby said plate subelements, in extending alongside a major portion of the blades on opposite sides thereof, protect and guide said cutter blades during usage of said slicing machine,

16. A sausage slicing machine comprising:

a framework;

a conveyor assembly mounted on said framework and including:

an endless member having an upper horizontal run and a lower horizontal run; and an articulated cradle subassembly secured to said endless member and comprising:

a trailing element secured to said endless member and extending transversely with respect to the direction of travel of the endless memeber and including transversely spaced, concavely recessed roll backing plates;

a central element secured to a different part of said endless member than said trailing element and movable independently of said trailing element, said central element extending transversely with respect to the direction of travel of the endless member and including transversely spaced, concavely recessed roll bottoming plates; and a leading element secured to a different part of said endless member than said trailing element and central element, and movable independently of said trailing element and said central element, said leading element including transversely spaced, concavely recessed roll confining plates;

said trailing, central and leading elements being responsive to the travel of said endless member in a straight path in said upper horizontal run to move into a contiguous, juxtapositioned relationship to each other defining a generally cylindrical, hollow interior in the cradle subassembly adapted to contain and confine a cylindrical sausage roll, and further being responsive to movement of said endless member to an arcuate circular path between said horizontal runs to open said elements apart from each other, whereby a sausage roll can be dropped into one of said concavely recessed plates; and a cutter assembly supported above said framework over said conveyor assembly and including a plurality of rotatable, transversely spaced cutter blades aligned with the spaces between said transversely spaced, concavely recessed roll backing plates, and with the spaces between said roll bottoming plates, and the spaces between said roll confining plates.

* * * * *

UNITED STATES PATENT OFFICE

CERTIFICATE OF CORRECTION

Patent No. 4,041,822 Dated August 16, 1977

Inventor(s) Floyd S. Gabel

It is certified that error appears in the above-identified patent and that said Letters Patent are hereby corrected as shown below:

Column 1, line 35, change "snd" to --and-- ;

Column 2, line 19, change "slice" to --sliced-- ;

Column 3, line 21, change "package" to --packaged-- ;

Column 3, line 22, change "pair" to --part-- ;

Column 4, line 24, change "plate" to --plates-- ;

Column 5, line 23, change "are" to --for-- ;

Column 5, line 34, change "close-up" to --closed-up-- ;

Column 6, line 18, change "gate" to --grate-- ;

Column 6, line 24, change "bu" to --by-- ;

Column 6, line 34, change "gate" to --grate-- ;

Column 6, line 64, change "opposit" to --opposite-- ;

UNITED STATES PATENT OFFICE

CERTIFICATE OF CORRECTION

Patent No. 4,041,822 Dated August 16, 1977

Inventor(s) Floyd S. Gabel

It is certified that error appears in the above-identified patent and that said Letters Patent are hereby corrected as shown below:

Column 7, line 18, change "wa" to --way-- ;

Column 7, line 33, change "note" to --noted-- ;

Column 9, line 18, change "tww" to --two-- ;

Column 12, line 34, change "incuding" to --including--

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*